US011325387B2

(12) United States Patent
Luke et al.

(10) Patent No.: US 11,325,387 B2
(45) Date of Patent: May 10, 2022

(54) BIASED PRINT GASKETS

(71) Applicant: Hewlett-Packard Development Company, L.P., Spring, TX (US)

(72) Inventors: Jeffrey H. Luke, Boise, ID (US); Mathew Lavigne, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/972,210

(22) PCT Filed: Nov. 14, 2018

(86) PCT No.: PCT/US2018/061010
§ 371 (c)(1),
(2) Date: Dec. 4, 2020

(87) PCT Pub. No.: WO2020/101667
PCT Pub. Date: May 22, 2020

(65) Prior Publication Data

US 2021/0229449 A1 Jul. 29, 2021

(51) Int. Cl.
*B41J 2/175* (2006.01)

(52) U.S. Cl.
CPC ..... *B41J 2/1753* (2013.01)

(58) Field of Classification Search
CPC .. B41J 2/1753; B41J 2/17506; B41J 2/17509; B41J 2/17566; B41J 2/175
USPC ..... 347/85
See application file for complete search history.

(56) References Cited

U.S. PATENT DOCUMENTS

| | | | | |
|---|---|---|---|---|
| 5,267,003 | A | 11/1993 | Grappiolo | |
| 9,592,675 | B2 | 3/2017 | Matsumoto et al. | |
| 2004/0165048 | A1 | 8/2004 | Ma et al. | |
| 2007/0211105 | A1* | 9/2007 | Furukawa | B41J 2/1645 347/45 |
| 2009/0290901 | A1* | 11/2009 | Ishii | G03G 15/0818 399/103 |
| 2009/0324295 | A1 | 12/2009 | Håkansson | |
| 2011/0292131 | A1* | 12/2011 | Wei | B41J 2/175 347/61 |
| 2013/0155146 | A1 | 6/2013 | Mealy et al. | |
| 2013/0265352 | A1 | 10/2013 | Burress et al. | |
| 2017/0288120 | A1* | 10/2017 | Higashiyama | F16N 7/36 |

FOREIGN PATENT DOCUMENTS

| | | |
|---|---|---|
| EP | 0 754 556 A2 | 1/1997 |

* cited by examiner

*Primary Examiner* — Kristal Feggins
*Assistant Examiner* — Alexander D Shenderov
(74) *Attorney, Agent, or Firm* — Jefferson IP Law, LLP

(57) ABSTRACT

In various examples, biased print gaskets can include a non-transitory machine-readable medium storing instructions executable by a processing resource to charge a material included in a gasket with a first bias voltage to repel print particles from a surface of the gasket, cease charging the material with the first bias voltage and charge the material with a second bias to attract print particles to a surface of the gasket.

20 Claims, 6 Drawing Sheets

BIASED PRINT GASKETS

BACKGROUND

Various printing devices may apply a quantity of colorant such as a printing fluid and/or printing particulates to a print medium such as paper or other type of print medium. The printing devices may include a receptacle that contains the printing fluid and/or printing particulates.

DETAILED DESCRIPTION

As mentioned, printing devices can apply a quantity of colorant such as printing fluid and/or print particles to a print medium. Examples of printing devices include ink/toner printers and/or three-dimensional printers, among other types of printing devices. The printing devices can include a receptacle to provide print particles to a printhead and/or other component that can apply print particles to a print medium. The receptacle may have a finite amount of print particles disposed within a volume of the receptacle. As such, the amount of print particles in the receptacle may be reduced during operation of the printing device, for instance, due to application of print particles from the receptacle to print medium. At some point, an amount of print particles in the receptacle may be less than a threshold amount of print particles for the printing device to operate as intended. Accordingly, the receptacle may be filled (e.g., refilled) with print particles to maintain an amount of print particles that is greater than the threshold amount of print particles.

However, filling of a printing device with print particles (e.g., toner particles) can lead to the print particles inadvertently being introduced into an environment surrounding the printing device. When in an environment surrounding the printing device the print particles may cause environmental, aesthetic, and/or other concerns.

As such, the disclosure is directed to biased print gaskets such as those included in a printing device and/or a container (e.g., a refill bottle) that is to couple to the printing device. For example, a non-transitory machine-readable medium can store instructions executable by a processing resource to charge a material included in a gasket with a first bias voltage to repel print particles from a surface of the gasket, cease charging the material with the first bias voltage and charge the material with a second bias to attract print particles to a surface of the gasket.

As used herein, a biased gasket refers to a gasket that has an electrical charge (e.g., a positive or negative electrical charge) imparted on the gasket by a power supply coupled to the gasket. That is, a gasket can be biased with a first bias charge to selectively repel printing particles from the gasket. The first bias charge can be a negative charge or a positive charge. Additionally, the gasket can be biased with a second bias charge to selectively attract printing particles to the gasket. The second bias charge can be the other of a positive charge or a negative charge. Such selective gasket biasing can promote movement of print particles from a container into a printing device (e.g., biasing the gasket with the first bias charge during a fill operation) and, notably, can capture stray print particles by attracting them to a gasket (e.g., biasing the gasket with the second bias charge following completion of the fill operation).

Figure 1:
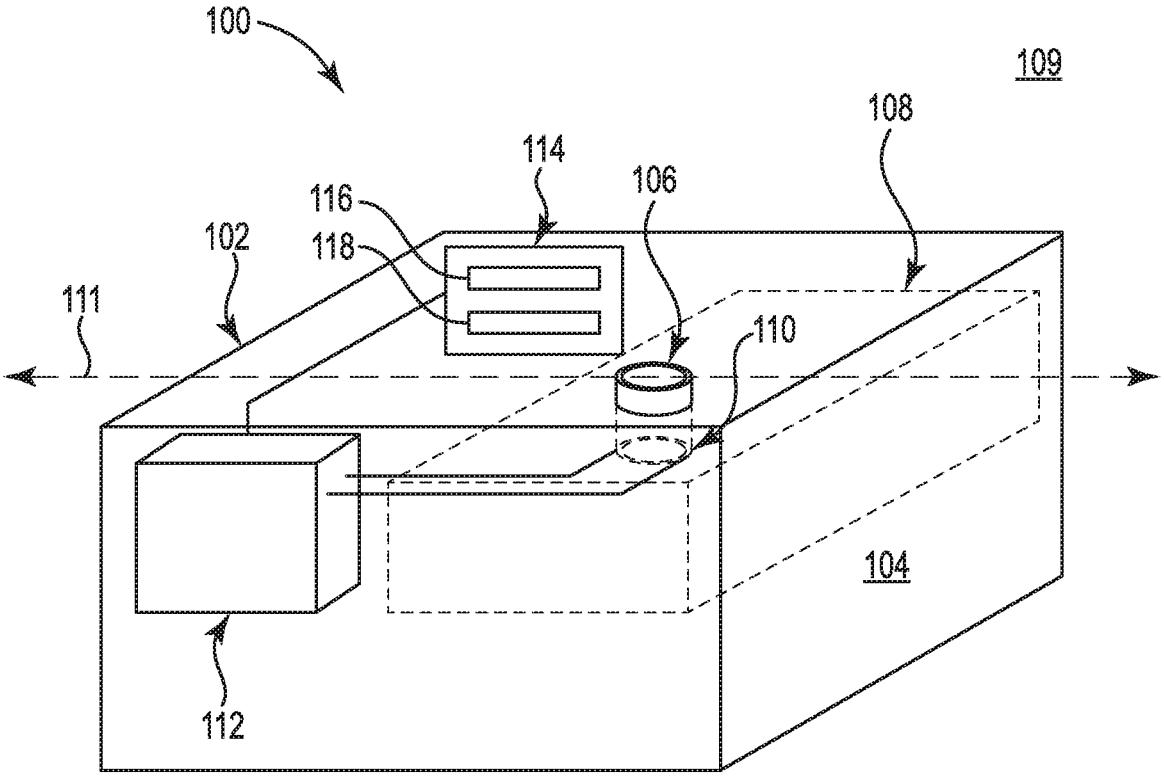
FIG. 1 illustrates a diagram of an example of a printing device according to the disclosure.

FIG. 1 illustrates a diagram of an example of a printing device 100 according to the disclosure. As used herein the printing device refers a device such as printers, copiers, etc., may generate text and/or images, etc. on a print medium (e.g., paper, plastic, etc.). As illustrated in FIG. 1, the printing device 100 can include a housing 102 defining a volume 104 of the printing device. As used herein, the term "housing" refers to a physical structure comprising a section of a container and/or a printing device. The housing 102 can form an exterior surface of the printing device 100.

The housing 102 can define an aperture 106 (i.e., a printing device side aperture). As illustrated in FIG. 1, the aperture 106 refers to an opening that extends from an environment 109 surrounding the printing device into the volume 104 of the printing device 100.

In various examples, the volume 104 can include a receptacle 108, among other possible components. As used herein, a receptacle refers to a component that is coupled to and is to provide print particles to a printhead, development area, and/or other imaging component of a printing device 100. That is, the receptacle 108 can permit supply of print particles from the receptacle 108 to a printhead, development area, and/or other imaging component that can apply print particles to a print medium.

As illustrated in FIG. 1, the printing device 100 can include a gasket 110 (i.e., a printing device side gasket). As used herein, a gasket refers to a shaped piece such as a ring of material that is to seal (in a liquid, solid, and/or air tight manner) a junction between two surfaces. For instance, a gasket can seal a junction between a printing device and a container. In some examples, the gasket can include and/or be formed entirely of a material capable of holding an electric charge (e.g., a conductive material). Examples of suitable materials include natural rubber, synthetic rubber, a metal infused plastic, or combinations thereof, among other possible gasket materials suitable to promote aspects of biased print gaskets.

As illustrated in FIG. 1, the printing device 100 can include a power supply 112 coupled to the gasket 100. As used herein a power supply refers to a device that is to electrically charge and thereby bias a gasket. Examples of suitable power supplies include a linear regulator, a multiple-phase regulator, a magnetic converter, an alternating current to direct current (AC-DC) converter (e.g., a rectifier, a main power supply unit, a switched-mode power supply, etc.), an AC-AC converter (e.g., a transformer, an autotransformer, a voltage converter, a voltage regulator, a cycloconverter, a variable-frequency transformer, etc.), and/or a DC to AC converter (e.g. an inverter), among other possible types of power supplies.

As illustrated in FIG. 1, the printing device 100 can include a controller 114. The controller 114 can include hardware such as a processing resource 116 and a memory resource 118, among other electronics/hardware to perform functions described herein. For instance, the controller 114 can be a combination of hardware and non-transitory instructions to provide a first bias voltage to repel the print particles from the gasket and/or provide a second bias voltage to attract the print particles to the gasket, among other functions.

The processing resource 116, as used herein, can include a processor capable of executing instructions stored by the memory resource 118. Processing resource 116 can be integrated in an individual device or distributed across multiple devices (e.g., multiple printing devices). The instructions (e.g., non-transitory machine-readable instructions (MRI)) can include instructions stored on the memory resource 118 and executable by the processing resource 116 to implement a function (e.g., charge a material included in a gasket with a first bias voltage to repel print particles from a surface of the gasket, etc.).

The memory resource 118 can be in communication with the processing resource 116 and/or another processing resource. A memory resource, as used herein, can include components capable of storing instructions that can be executed by a processing resource. Such memory resource can be a non-transitory machine readable medium. Memory resource 118 can be integrated in an individual device or distributed across multiple devices. Further, memory resource 118 can be fully or partially integrated in the same device as the processing resource 116 or it can be separate but accessible to that device and the processing resource 116. Thus, it is noted that the controller 114 can be implemented as part of or in conjunction with the systems, containers, and printing devices, as described herein.

The memory resource 118 can be in communication with the processing resource 116 via a communication link (e.g., path). The communication link (not illustrated) can be local or remote to a device associated with the processing resource. Examples of a local communication link can include an electronic bus internal to a device where the memory resource is one of volatile, non-volatile, fixed, and/or removable memory resource in communication with the processing resource via the electronic bus.

In various examples, the controller 114 is to provide a bias voltage to the gasket to selectively attract or repel print particles (not illustrated in FIG. 1), when present in the receptacle, with respective to the gasket. For clarity, the gasket 110 can be biased in the absence and/or presence of print particles. For example, the gasket can be biased in advance of, during, and/or following completion of a fill operation. However, when present the print particles can be attracted to and/or repelled from a biased gasket. Examples of print particles include toner, carrier beads, polymers, and/or metallic particulates such as those suitable for three-dimensional printing.

For ease of illustration various components (e.g., the receptacle 108, the power supply 112, etc.) are illustrated as being visible from an outside of the printing device 100. However, it is understood that in some examples some or all of the components illustrated in FIG. 1 can be include in the housing 102 and not visible from an environment 109 surrounding the printing device 100.

Figure 2:
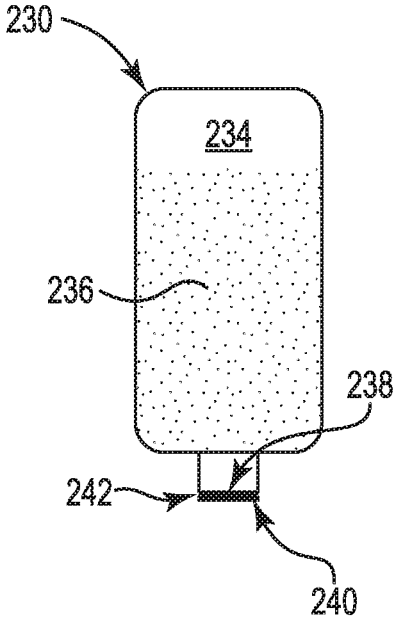
FIG. 2 illustrates a diagram of an example of a container according to the disclosure.

FIG. 2 illustrates a diagram of an example of a container 230 according to the disclosure. The container 230 can define a volume 234 and an aperture 238 (i.e., a container side aperture). The volume 234 can include print particles 236. The container 230 can be coupled to a printing device such as those described herein. For instance, the container 230 can be removably coupled to the printing device to permit couple, decoupling, and subsequent coupling of another container (not illustrated) to the printing device.

When coupled to the printing device (e.g., as described with respect to FIGS. 3 and 4 herein) the container 230 can be in communication with a receptacle of the printing device to permit communication of printing particles 236 from the volume 234 into the receptacle of the printing device, as detailed herein. As illustrated in FIG. 2, the container 230 can include a gasket 240 (i.e., a container side gasket) disposed in the aperture 238. In some examples, the gasket 240 can be disposed around an entire periphery of the aperture 238. For instance, gasket 240 can be circular or other shape to be disposed around a periphery of the aperture 238, but yet permit print particles 236 to pass from the volume 234 through a center of the gasket 240 or otherwise into a receptacle of a printing device (not illustrated in FIG. 2), as detailed herein.

In various examples, the gasket 240 (similar or the same as gasket 110 as described with respect to FIG. 1) can include and/or be formed entirely of an a material capable of holding an electric charge. As mentioned, examples of suitable materials include natural rubber, synthetic rubber, a metal infused plastic, or combinations thereof, among other possible gasket materials suitable to promote aspects of biased print gaskets.

Figure 4:
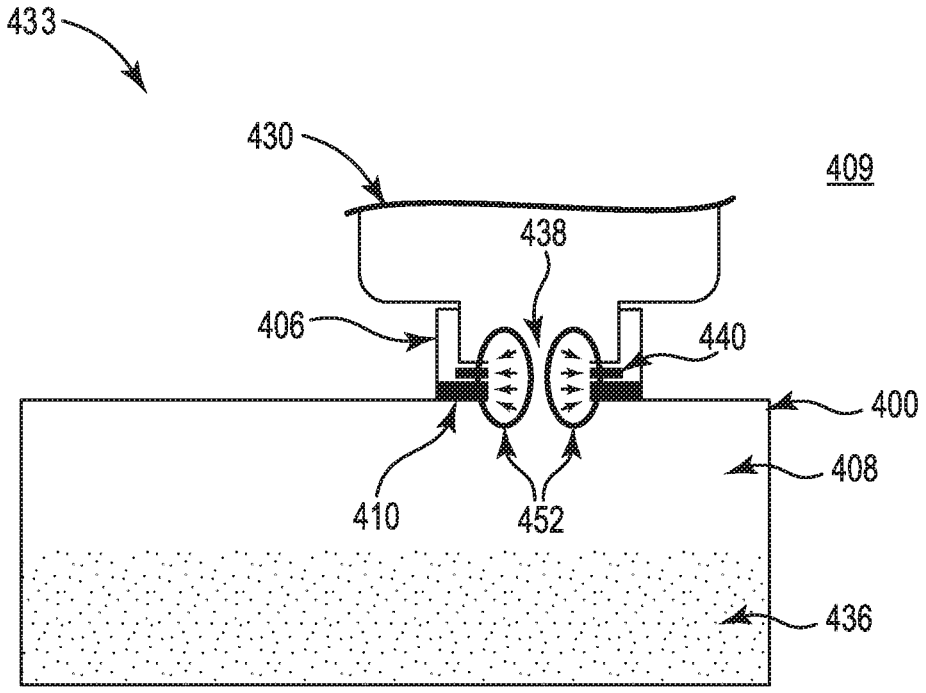
FIG. 4 illustrates a diagram of an example of a system following completion of a fill operation according to the disclosure.
Figure 5:
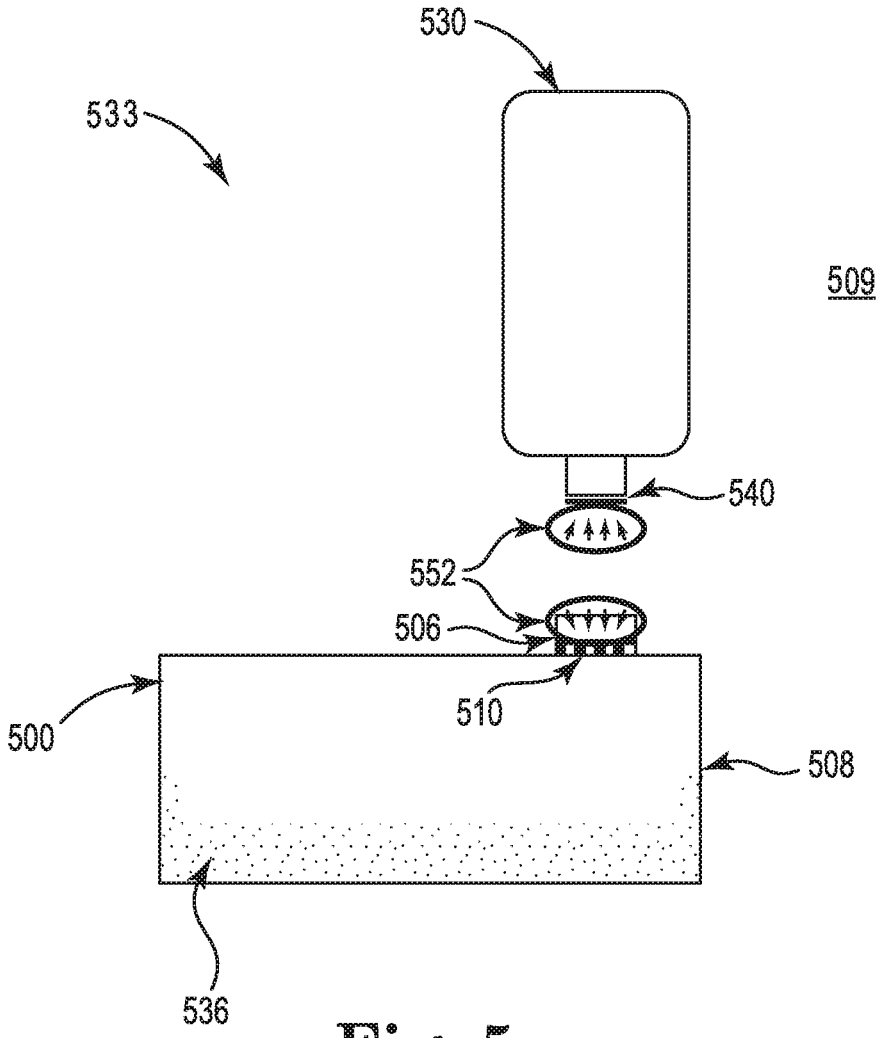
FIG. 5 illustrates a diagram of an example of a system following completion of a fill operation and decoupling of the system according to the disclosure.

In various examples, the container 230 can include a dedicated electrical contact 242. As used herein, a dedicated electrical contact 242 refers to an electrical contact provided for a particular predetermined function or combination of functions. For instance, in various examples the dedicated electrical contact is to couple to a power supply, such as those described herein, and when coupled to the power supply provide a bias voltage to the gasket 240. In this manner, the gasket 240 can be biased to selectively attract and/or selectively repel print particles respective to the gasket 240. For instance, FIGS. 3, 4, and 5 provide examples of selective attraction and/or selectively repulsion of print particles respective to a gasket.

Figure 3:
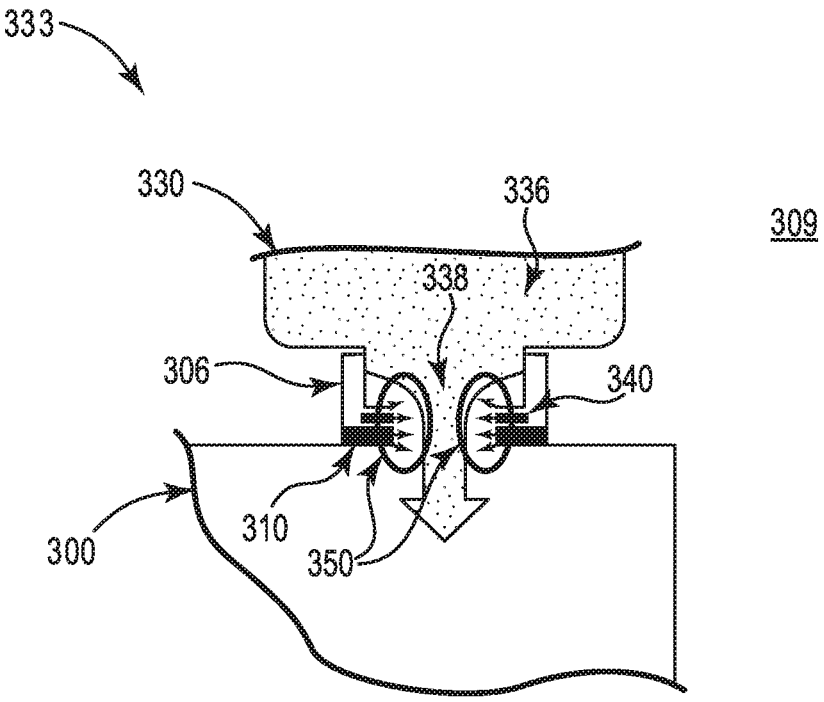
FIG. 3 illustrates a diagram of an example of a system during initiation of a fill operation according to the disclosure.

FIG. 3 illustrates a diagram of an example of a system 333 during a fill operation according to the disclosure. As illustrated in FIG. 3, the system 333 can include a printing device 300 and a container 330. Printing device 300 is analogous or similar to printing device 100, 400, and/or 500 as described with respect to FIGS. 1, 4, and 5, respectively. For instance, each of FIGS. 3, 4, and 5 includes a section view of a portion of a printing device 100 taken along section line 111 of FIG. 1. The container 330 is analogous or similar to container 230, 430 and/or 530 as illustrated with respect to FIGS. 2, 4, and 5, respectively. For instance, each of FIGS. 3, 4, and 5 includes a portion of the container 230 of FIG. 2.

For instance, printing device 300 includes an aperture 306. As illustrated in FIG. 3, the container 330 can be coupled to the printing device 300 by disposing a portion of the container 330 in the aperture 306. In some examples, the printing device 300 and/or the container 330 can include a sensor (e.g., contact circuit, optical sensor, etc.) to detect when the container 330 is coupled to the printing device 300. When the container 330 is coupled to the printing device 300 print particles 336 can be provided from the container 330 via aperture 338 and the aperture 306 into the printing device 300 during a fill operation. In such examples, a gasket 310 can contact gasket 340 to together seal the interface between the container 330 and the printing device 300 so the print particles 336 do not translate into an environment 309 surrounding the system 333.

The gasket 310 and/or the gasket 340 can be biased with a first bias voltage to repel print particles from a surface of the gasket (as represented by arrows 350). That is, a material in gasket 310 and/or gasket 340 can be charged with a first bias voltage to repel print particles from a surface of gasket 310 and/or gasket 340. In some examples, both gasket 310 and gasket 340 can be charged (e.g., at the same time) with a first bias voltage to repel print particles from surfaces of both gasket 310 and gasket 340. The first bias voltage 350 can be applied responsive to initiation of a refill process and/or can be maintained during a fill process (e.g., maintained during an entirety of a fill operation), among other possibilities. In any case, such biasing can promote movement of the print particles 336 from the container 330 into the printing device 300.

FIG. 4 illustrates a diagram of an example of a system 433 following completion of a fill operation according to the disclosure. As used herein, completion of a fill operation can refer to a state when a receptacle 408 includes a particular amount of print particles following the addition of print particles to the receptacle 408. For instance, a fill operation can be deemed "complete" when an amount of print particles in the receptacle is greater than a threshold amount of print particles for the printing device to operate as intended and/or when the receptacle has received a total amount of print particles originally present (before completion of a fill operation) in the container 430. As used herein, initiation of a fill process refers a point in time when print particles begin to translate from the container 430 into the printing device 400 (e.g., into the receptacle 408 of the printing device 400).

As illustrated in FIG. 4, the system 433 can include a printing device 400 and a container 430. Printing device 400 is analogous or similar to printing device 100, 300, and/or 500 as described with respect to FIGS. 1, 3, and 5, respectively. The container 430 is analogous or similar to container 230, 330, and/or 530 as described with respect to FIGS. 2, 3, and 5, respectively.

As mentioned, the container 430 can be coupled to the printing device 400. As such, print particles 436 can be provided from the container 430 via aperture 438 and aperture 406 into the printing device 400 during a fill operation. As mentioned, gasket 410 of the printing device 400 can contact gasket 440 of the container 430 to together seal the interface between the container 430 and the printing device 400 so the print particles 436 do not translate into an environment 409 surrounding the system 433.

Moreover, the gasket 410 and/or the gasket 440 can be biased with a second bias voltage to attract print particles to a surface of the gasket 410 and/or the gasket 440 (as represented by arrows 452). That is, a material in gasket 410 and/or gasket 440 can be charged with a second bias voltage to attract print particles to surface of gasket 410 and/or gasket 440. In some examples, both gasket 410 and gasket 440 can be charged (e.g., at the same time) with a second bias voltage to attract print particles to surfaces of both gasket 410 and gasket 440.

Such biasing can retain any stray print particles of the print particles 436 from translating to the environment 409 when the container 430 is decoupled from the printing device. For instance, in some examples a gasket can be provided with the second bias voltage in advance of and/or responsive to decoupling of the container 430 decoupling from the printing device 400. For example, the gasket 440 in the container 430 and/or the gasket 410 included in the printing device 400 can be provided with the second bias voltage responsive to completion of a fill operations, among other possibilities.

In some examples, a second basis voltage can be provided to and/or maintained to the gasket 410 in the printing device following decoupling of the container 430 from the printing device to attract stray print particles even when the container 430 and the printing device 400 are decoupled. As used herein, being decoupled refers to an absence of physical contact between two devices such as a container and a printing device whereas being coupled refers to the presence of physical contact between two devices.

In some examples, a material capable of holding an electric charge can be positioned in a gasket such as the gasket 410 and/or the gasket 440 to form a capacitor. As used herein, a capacitor refers to a structure that can store energy electrostatically in an electrical field. In this manner, the gasket 410 and/or the gasket 440 can maintain a bias voltage such as the second bias voltage for a period of time after the bias voltage ceases to be applied (e.g., by a power supply) to the gasket. For instance, a power supply included in a printing device can provide a second bias voltage to the gasket 440 included in the container 430 and the gasket 440 can maintain a portion of the charge for a period of time even subsequent to being decoupled from the printing device 400 (and therefore decoupled from the power supply).

In some examples, the second bias voltage 452 can be provided responsive to completion of a fill operation, responsive to a user input, or otherwise provide. In some examples, the second bias voltage 452 can be maintained for a predetermined time (e.g., 30 seconds, 1 minute, etc.) following the fill operation or can be maintained until receipt of an input. Examples of such inputs include an input provided by a user (e.g., via a button or graphical user interface of the printing device) and/or an input that causes the container 430 to decouple from the printing device 400.

In various examples, a first bias voltage can have a negative electrical polarity or a positive electrical polarity. In such examples, the second bias voltage can have the other of the negative electrical polarity or the positive electrical polarity. In this manner, the physical effect of the first bias voltage on print particles (e.g., repulsion of the print particles from a surface of a gasket) can be the opposite of the physical effect of the second bias voltage on the print particles (e.g., attraction of the print particles to the surface of the gasket).

A gasket can be ceased from being charged with the first bias voltage in advance of charging the gasket with a second bias voltage. For instance, in some examples, responsive to cessation of the first bias voltage, the gasket can be charged with a second bias voltage. However, the disclosure is not so limited. Rather in some examples a delay in time between charging the gasket with the first bias voltage and the second bias voltage can be employed. Such a delay can permit an electrical charge to dissipate or be eliminated in advance of providing the second bias voltage to the gasket.

In some examples, an interim voltage can be provided to a gasket. As used herein, an interim voltage refers to a voltage with a different polarity than both of the first bias voltage and the second bias voltage. For instance, the interim voltage (e.g., having a neutral polarity) can be applied responsive to cessation of providing the first bias voltage to a gasket and in advance of providing the second bias voltage to the gasket. In such examples, the interim voltage can facilitate and/or expediate dissipation of another bias voltage such as the first bias voltage.

FIG. 5 illustrates a diagram of an example of a system 533 following completion of a fill operation and decoupling of the system according to the disclosure. As illustrated in FIG. 5, the system 533 can include a printing device 500 and a container 530. Printing device 500 is analogous or similar to printing device 100, 300, and/or 400 as described with respect to FIGS. 1, 3, and 4, respectively. The container 530 is analogous or similar to container 230, 330, and/or 430 as described with respect to FIGS. 2, 3, and 4, respectively.

As illustrated in FIG. 5, the container 530 can be decoupled from the printing device 500. As such, gasket 510 of the printing device 500 does not contact gasket 540 of the container 530. However, as illustrated in FIG. 5, a second bias voltage can be provided to a gasket to attract print particles as represented as 552 in FIG. 5. That is, the second bias voltage can be provided to the gasket 510 of the printing device 500 and/or to the gasket 540 of the container 530 so the print particles 536 do not translate into an environment 509 surrounding the system 533. As mentioned the second bias voltage can be maintained to the gasket of the printing device following decoupling of the container 530 from the printing device to ensure print particles 536 remain in or otherwise in contact with the printing device 500 and do not escape from receptacle 508 into the environment 509.

Similarly, the gasket 540 in the container 530 can be or include a material capable of holding an electric charge to form a capacitor to receive and maintain some or all of the second bias voltage even when decoupled from an aperture 506 of the printing device 500 (and a power supply included in the printing device). In this manner, the gasket 540 when biased with the second bias voltage can ensure any residual print particles (not transferred into receptacle 508) remain in or otherwise in contact with the container 530 and do not escape into the environment 509.

While FIGS. 3, 4, and 5 each illustrate two distinct gaskets (e.g., gasket 310 and gasket 340 as illustrated in FIG. 3) the disclosure is not so limited. Rather, in some examples an individual gasket can be employed. For instance, a gasket (e.g., gasket 310 as illustrated in FIG. 3) can be present while the other gasket (e.g., gasket 340 as illustrated in FIG. 3) is not present. Stated differently, in some examples a system can include a container side gasket but not a printing device side gasket or can include a printing device side gasket but not a container side gasket. Consequently, is it understood that the systems herein can include a gasket included in a container, a gasket included in a printing device and/or a respective gaskets included in both of a printing device and a container.

Figure 6:
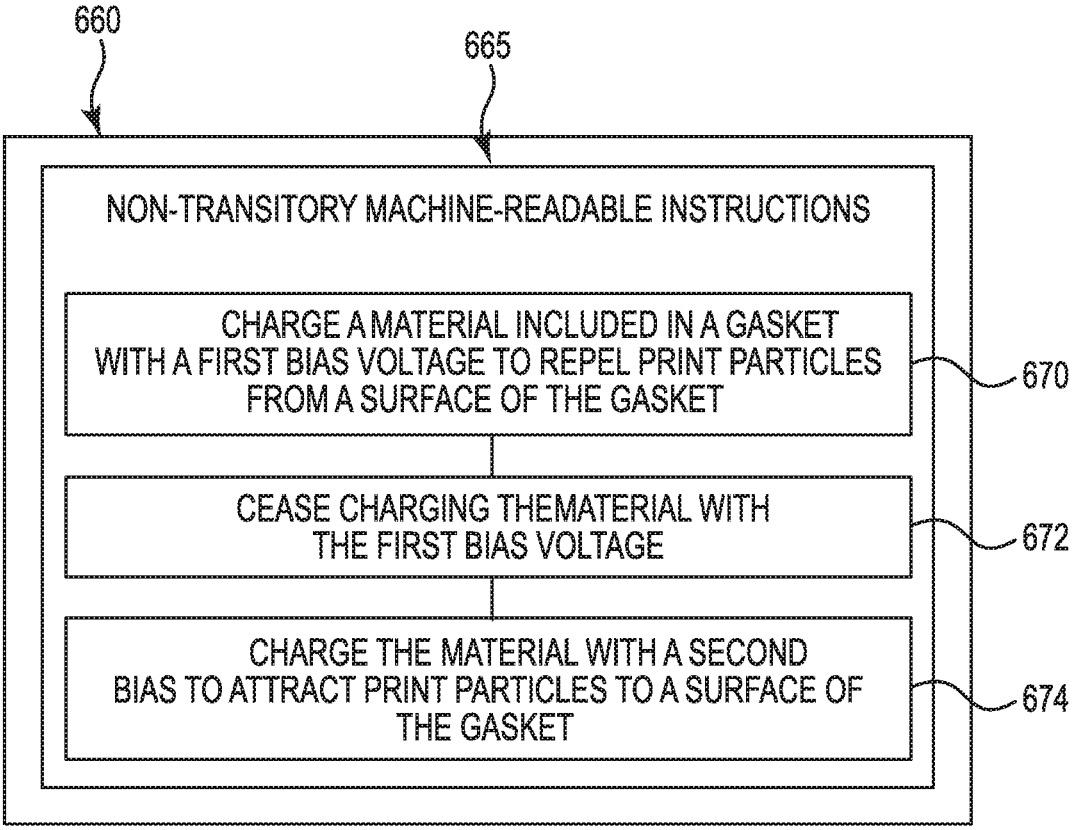
FIG. 6 illustrates an example of a non-transitory machine-readable medium including non-transitory machine-readable instructions according to the disclosure.

FIG. 6 illustrates an example of a non-transitory machine-readable medium 660 (i.e., a memory resource) including non-transitory machine-readable instructions 665 according to the disclosure. As illustrated at 670, the non-transitory machine-readable instructions 665 can include instructions executable by a processing resource to charge a material included in a gasket with a first bias voltage to repel print particles from a surface of the gasket, as described herein. As illustrated at 672, the non-transitory machine-readable instructions 665 can include instructions executable by a processing resource to cease charging the material with the first bias voltage, as described herein.

As illustrated at 674, the non-transitory machine-readable instructions can include instructions executable by a processing resource to charge the material with a second bias to attract print particles to a surface of the gasket, as described herein. The non-transitory machine-readable instructions 665 can include instructions (not illustrated) to determine when various stages such as initiation, being underway, and/or completion of a fill process occur, among other possibilities.

In the foregoing detailed description of the present disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the present disclosure.

The figures herein follow a numbering convention in which the first digit corresponds to the drawing figure number and the remaining digits identify an element or component in the drawing. For example, reference numeral 100 may refer to element "00" in FIG. 1 and an analogous element may be identified by reference numeral 200 in FIG. 2. Elements shown in the various figures herein can be added, exchanged, and/or eliminated so as to provide a number of additional examples of the present disclosure. In addition, the proportion and the relative scale of the elements provided in the figures are intended to illustrate the examples of the present disclosure and should not be taken in a limiting sense.

It will be understood that when an element is referred to as being "on," "connected to" or "coupled with" another element, it can be directly on, connected, or coupled with the other element or intervening elements may be present. In contrast, when an element is referred to as being "directly on," "directly connected to" or "directly coupled with" another element, there are no intervening elements or layers present. As used herein, the term "and/or" includes any and all combinations of a number of the associated listed items. As used herein the term "or," unless otherwise noted, means logically inclusive or. That is, "A or B" can include (A), (B), or (both A and B). In other words, "A or B" can mean "A and/or B" or "at least A or B.".

What is claimed is:

1. A container comprising:

a housing defining a volume and an opening;

a gasket including a material capable of holding an electric charge, wherein the gasket is disposed in the opening;

print particles disposed in the volume; and a dedicated electrical contact coupled to the gasket, wherein the dedicated electrical contact is to couple to a power supply and, when coupled to the power supply, provide a bias voltage to the gasket to selectively attract or repel the print particles respective to the gasket.

2. The container of claim 1, wherein the material capable of holding an electric charge is positioned in the gasket to form a capacitor.

3. The container of claim 1, wherein the material capable of holding an electric charge further comprises natural rubber, synthetic rubber, a metal infused plastic, or combinations thereof.

4. A printing device comprising:

a housing defining a receptacle having internal volume;

a gasket including a material capable of holding an electric charge, wherein the gasket is disposed in the receptacle;

a power supply coupled to the gasket; and a controller to provide a bias voltage to the gasket to selectively attract or repel print particles, when present in the receptacle, with respective to the gasket.

5. The printing device of claim 4, wherein the controller is further to provide the bias voltage to the gasket to selectively attract or repel the print particles when a container is coupled to the printing device.

6. The printing device of claim 5, wherein the controller is further to:

provide a first bias voltage to repel the print particles from the gasket responsive to detection of the container being coupled to the printing device; and provide a second bias voltage to attract the print particles to the gasket responsive to the container being decoupled from the printing device.

7. The printing device of claim 6, wherein the first bias voltage has a negative electrical polarity or a positive electrical polarity.

8. The printing device of claim 7, wherein the second bias voltage has the other of the negative electrical polarity or the positive electrical polarity.

9. The printing device of claim 6, wherein the first bias voltage is provided responsive to initiation of a fill process.

10. The printing device of claim 9, wherein the first bias voltage is maintained during the fill process.

11. The printing device of claim 10, wherein the second bias voltage is provided responsive to completion of the fill process.

12. The printing device of claim 11, wherein the second bias voltage is maintained for a predetermined time following the fill process or until receipt of an input.

13. The printing device of claim 6, wherein the gasket includes a first gasket and a second gasket, wherein the first gasket and the second gasket are charged with the first bias voltage to repel the print particles from each of the first gasket and the second gasket, wherein the charging of the first gasket and the second gasket with the first bias voltage is ceased, and wherein, responsive to cessation of the first bias voltage, the first gasket and the second gasket are charged with the second bias voltage to attract the print particles to each of the first gasket and the second gasket.

14. A printing device comprising:

a housing including a receptacle;

a power supply;

a gasket including a material to hold an electric charge, the gasket disposed in the receptacle; and a controller to provide a bias voltage to the gasket to selectively attract or repel print particles with respective to the gasket.

15. The printing device of claim 14, wherein the controller is further to provide the bias voltage to the gasket to selectively attract or repel the print particles based on coupling of a container to the printing device.

16. The printing device of claim 15, wherein the controller is further to:

provide a first bias voltage to repel the print particles from the gasket responsive to detection of the container being coupled to the printing device, and provide a second bias voltage to attract the print particles to the gasket responsive to the container being decoupled from the printing device.

17. The printing device of claim 16, wherein the first bias voltage has a negative electrical polarity or a positive electrical polarity, and wherein the second bias voltage has the other of the negative electrical polarity or the positive electrical polarity.

18. The printing device of claim 16, wherein the first bias voltage is provided responsive to initiation of a fill process and is maintained during the fill process.

19. The printing device of claim 18, wherein the second bias voltage is provided responsive to completion of the fill process, and wherein the second bias voltage is maintained for a predetermined time following the fill process or until receipt of an input.

20. The printing device of claim 16, wherein the gasket includes a first gasket and a second gasket, wherein the first gasket and the second gasket are charged with the first bias voltage to repel the print particles from each of the first gasket and the second gasket, wherein the charging of the first gasket and the second gasket with the first bias voltage is ceased, and wherein, responsive to cessation of the first bias voltage, the first gasket and the second gasket are charged with the second bias voltage to attract the print particles to each of the first gasket and the second gasket.

* * * * *